United States Patent [19]

Roster

[11] Patent Number: 4,676,170

[45] Date of Patent: Jun. 30, 1987

[54] ONE-PIECE WAD STRUCTURE ADAPTED FOR RELOADING OF HARD SHOT

[75] Inventor: Thomas A. Roster, Klamath Falls, Oreg.

[73] Assignee: Non-Toxic Components, Inc., Portland, Oreg.

[21] Appl. No.: 873,489

[22] Filed: Jun. 12, 1986

Related U.S. Application Data

[63] Continuation of Ser. No. 631,451, Jul. 16, 1984, abandoned.

[51] Int. Cl.[4] ..... F42B 7/00

[52] U.S. Cl. ..... 102/449; 102/532

[58] Field of Search ..... 102/448–463, 102/432

[56] References Cited

U.S. PATENT DOCUMENTS

| | | | |
|---|---|---|---|
| 157,793 | 12/1974 | Cochran | 102/453 |
| 3,208,382 | 9/1965 | Foote et al. . | |
| 3,215,076 | 11/1965 | Foote et al. . | |
| 3,217,648 | 11/1965 | Foote et al. . | |
| 3,285,174 | 11/1966 | Moehlman et al. . | |
| 3,289,586 | 12/1966 | Horn et al. . | |
| 3,444,777 | 5/1969 | Lage | 102/453 |
| 3,721,194 | 3/1973 | Weston, Jr. . | |
| 3,722,420 | 3/1973 | Herter . | |
| 3,750,580 | 8/1973 | Nomura et al. . | |
| 3,786,753 | 1/1974 | Eckstein et al. . | |
| 3,835,783 | 9/1974 | Curran | 102/451 |
| 3,974,775 | 8/1976 | Kerzman | 102/451 |
| 4,103,621 | 8/1978 | Fackler | 102/453 |
| 4,220,090 | 9/1980 | Fackler . | |
| 4,233,903 | 11/1980 | Lage | 102/449 |

FOREIGN PATENT DOCUMENTS

| | | | |
|---|---|---|---|
| 1408820 | 7/1965 | France | 102/449 |

*Primary Examiner*—Harold J. Tudor

*Attorney, Agent, or Firm*—Chernoff, Vilhauer, McClung & Stenzel

[57] ABSTRACT

A one-piece, elongate, tubular shot shell wad structure, for use with ferrous metal and other hard shot, having a shot cup and obturating cup separated by a relatively small distance and yet having a cushioning capability for limiting peak powder chamber pressure upon firing and reducing choke strain. The cushioning structure comprises a specially formed annular depression formed in the exterior surface of the wad structure located at the juncture between the shot cup and obturating cup. The depression cooperates with the tubular wall of the obturating cup in such a way as to provide not only cushioning but also improved sealing upon firing. The shot cup has a hemispherical bottom surface which, despite the presence of the cushioning depression, does not undergo any substantial deformation upon firing and is therefore effective to further reduce choke strain.

2 Claims, 4 Drawing Figures

ONE-PIECE WAD STRUCTURE ADAPTED FOR RELOADING OF HARD SHOT

This application is a continuation of application Ser. No. 631,451, filed July 16, 1984, now abandoned.

The present invention is directed to a shot shell wad structure having a shot cup specially adapted for containing relatively hard shot, composed of ferrous metal pellets or the like, and for protecting a gun barrel and choke from abrasion and strain during firing of such shot. The wad structure is particularly adapted for use in reloading shot shells, for cushioning against excessive peak powder chamber pressures, and for ensuring relatively high uniformity of shot patterns and shot velocities despite the variable characteristics of powders available for reloading and the variety of different shot shell cases which are reloaded.

Wad structures for lead shot function to protect the shot, because of its softness, from deformation due to powder chamber pressure and contact with the gun barrel and choke. Conversely, wad structures for hard ferrous metal shot and the like perform entirely different functions. One such function is protection of the interior surface of the barrel from abrasion, and protection of the choke from permanent deformation, by the hard shot. This general function is discussed, for example, in Eckstein et al. U.S. Pat. No. 3,786,753 which utilizes a two-piece wad having a specially formed shot cup composed of high-density polyethylene or similar plastic not penetrable by the hard shot pellets upon firing. Such wad also has an irregularly-shaped shot cup base to minimize transverse diameter-to-diameter contact between the pellets so that their column can be elongated by the choke through the application of reduced constricting force. One-piece wads for ferrous metal shot are also known, having either irregular or flat shot cup bases as shown, for example, in Foote et al., U.S. Pat. No. 3,208,382.

The aforementioned Eckstein et al. patent also discusses the desirability of a small degree of built-in cushioning or compressibility in the wad to improve "interior ballistics." Although not showing the feature, the patent mentions that such cushioning can be obtained by increasing the separation between the shot cup and the obturating (powder) cup of the wad structure to create space for interposing an intermediate cushioning section between them, analogous to that provided in Foote et al., U.S. Pat. Nos. 3,215,076 and 3,217,648. However, the Eckstein patent warns that this can be done only if a reduction in the volume available for shot and powder may be tolerated (because of the additional space required for the cushioning section which reduces the volume of the two cups). This prerequisite to the use of an intermediate cushioning structure is indicative of the fact that the resultant space constriction sacrifices both flight velocity and shot pattern due to reduced shot and powder volumes. For this reason, such cushioning structures are usually used commercially only in wads for soft lead shot where they are considered critical to prevent deformation of the shot pellets, as shown for example in U.S. Pat. Nos. 3,285,174, 3,289,586, 3,721,194, 3,750,580 and 4,220,090. Where wads for hard ferrous shot are concerned, such cushioning structures are normally eliminated because their "interior ballistics" advantages are not considered significant enough to outweigh the disadvantages of reducing shot and powder volume.

However, the elimination of cushioning from a hard shot wad for the above reasons ignores the fact that such cushioning can serve a more important purpose in such wads than merely improving interior ballistics. The function referred to is that of limiting peak powder chamber pressure. This function is particularly important if the wad is to be used for reloading, where less uniformity in powder characteristics and volume of powder than in factory-loaded shot shells is to be expected. Accordingly, what is needed is a structure which provides the necessary cushioning function without necessitating a reduction in shot cup or obturating cup volume.

A further necessary wad function, particularly if it is to be used for reloading, is the versatile ability of its obturating cup, which overlies the powder chamber, to form a consistent seal with a variety of different shell cases and gun barrels which, even though their nominal dimensions may be the same, have somewhat different actual interior dimensions. The ballistics of the shot are highly dependent upon the integrity of the obturating cup seal, and such seal must therefore be relatively uniform from shell to shell and from gun to gun so that relatively uniform ballistics can be reasonably relied upon by the shooter. Most prior obturating cups have surrounding walls or skirts which are tapered to relatively thin, flexible sections at the edge of the cup, as shown for example in Herter U.S. Pat. No. 3,722,420. This gives the wall a degree of conformable sealing capability at its edge. Unfortunately, such conformability is insufficient to ensure the uniformity of ballistics in reloaded shells because the combined variables of powder characteristics, shell case type, and barrel dimensions, not encountered in the use of factory ammunition, require more versatile and conformable sealing than has previously been possible. One of the reasons why existing obturating cups do not provide this degree of conformability is that only the edge portion of their wall is outwardly expandable into sealing contact, whereas the upper, thicker portion of the wall is not outwardly expandable and, in many cases, is actually susceptible to deforming upwardly and inwardly upon firing which inhibits, rather than aids, effective sealing.

Finally, a wad for hard shot should have a nonplanar shot cup base to minimize transverse diameter-to-diameter contact between the pellets so that their column can be elongated by the choke with a minimum of constricting force so as to minimize choke strain, as discussed in the aforementioned Eckstein et al. patent. The conical base shape shown therein for this purpose, however, is not the most effective shape. Although a hemispherical shot cup base is shown in Herter U.S. Pat. No. 3,722,420, it is incapable of minimizing transverse diameter-to-diameter contact of the pellets during their passage through the choke because the base deforms into a relatively flat configuration upon firing in order to provide a cushioning function.

SUMMARY OF THE INVENTION

The present invention is directed to a wad structure for hard shot, of the ferrous metal or comparable type, which solves the aforementioned deficiencies of prior wads.

The need for a cushioning structure which does not necessitate a reduction in shot cup or obturating cup volume is satisfied by employing a relatively thin, non-cushioning partition between the obturating cup and shot cup in combination with an exterior annular depression formed at a location along the length of the wad structure corresponding substantially to the location of the partition. This annular depression provides a space into which the upper portion of the wall of the obturating cup can deform upwardly upon firing so as to provide the cushioning necessary to limit peak powder chamber pressures. Since this cushioning structure, unlike prior cushioning structures, does not require any space between the shot cup and obturating cup, neither cup suffers any reduction in volume thereby maximizing the amount of shot and powder which can be loaded into the shell case.

The further need for versatile sealing ability of the obturating cup, relative to a variety of different shell cases and gun barrels of varying internal dimension, is satisfied by forming the aforementioned cushioning depression in such relation to the obturating cup that it causes the top of the obturating cup wall, upon firing, to deform not only upwardly into the depression, but also simultaneously outwardly into tight sealing engagement with the shell case and barrel during discharge. This gives the obturating cup a degree of sealing conformability superior to that of prior obturating cups, and particular effective to provide greater uniformity of ballistics in reloaded shells.

Finally, the need to minimize choke strain by minimizing transverse diameter-to-diameter contact between the hard pellets is satisfied by the provision of a hemispherical shot cup base which, unlike the prior art, is substantially nondeformable upon firing and therefore maintains the optimum pattern of surface-to-surface contact of the shot pellets as they are discharged through the barrel. This function is performed compatibly with the aforementioned cushioning function due to the fact that the cushioning depression has a relatively shallow radial depth substantially no greater than the radial thickness of the tubular wall adjacent the shot cup base. Moreover, the minimizing of choke strain is further enhanced in the present invention by a second cushioning function whereby the shot cup wall, when its upper end encounters the choke, deforms downwardly (i.e. longitudinally) into the previously described annular depression so as to reduce its impact on the choke, again without deforming the hemispherical shot cup base.

The foregoing and other objectives, features and advantages of the present invention will be more readily understood upon consideration of the following detailed description of the invention taken in conjunction with the accompanying drawings.

DESCRIPTION OF THE PREFERRED EMBODIMENT

Figure 3:
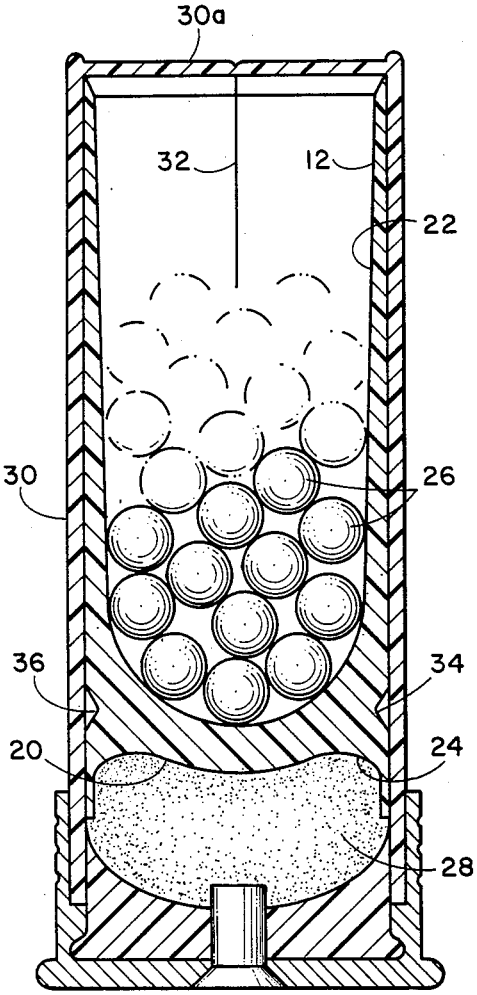
FIG. 3 is a longitudinal cross section of a typical shot shell containing the wad structure of FIG. 1 after the shot cup thereof has been slit.

The wad structure, designated generally as 10, is preferably constructed of molded high-density polyethylene material such as that described in U.S. Pat. No. 3,786,753, which is incorporated herein by reference. The wad structure 10 generally comprises an elongate tubular wall 12 of varying radial thickness extending between an upper end 14 and lower end 16. A transverse partition 20 separates an elongate shot cup 22, having a circular opening at the upper end 14 of the wad structure, from an obturating cup 24 having a circular opening at the lower end 16 of the wad structure. The shot cup 22 is for containing a charge of shot pellets 26 (only a partial charge being shown in FIG. 3), while the obturating cup 24 is intended to overlie a powder chamber filled with powder 28 at the base of a conventional shell case 30.

Although the wad structure 10 may be utilized in the original manufacture of ammunition, it is especially well adapted for use in reloading spent shell cases such as 30 with ferrous metal or comparable hard shot pellets 26. In such reloading, a predetermined amount of powder 28 is placed in the bottom of the shell case 30, after which the wad structure 10, which has been slit as described hereafter, is inserted into the case 30 with the obturating cup 24 covering the powder. The shot cup 22 is then filled with shot pellets 26 (and a buffer, if desired) and the top **30*a*** of the shot shell case is closed by crimping or folding, in the conventional manner, over the top of the wad structure and shot pellets.

Upon firing, the wad structure and pellets 26 are propelled in unison out the end **30*a* of the shell case and through the gun barrel. During such discharge the portion of the wall 12 surrounding the obturating cup 24 forms a peripheral seal, first with the interior surface of the shot shell case 30 and then with the interior surface of the gun barrel, so as to contain, and minimize the leakage of, the exploding gases beneath the obturating cup and thereby maximize their propelling effect. Simultaneously the portion of the wall 12 surrounding the shot cup 22 prevents contact between the shot pellets 26** and the interior surface of the gun barrel to prevent abrasion of the barrel.

Upon exiting the barrel, the wad structure separates from the shot pellets 26 by virtue of the fact that the portion of the wall 12 surrounding the shot cup chamber has been slit longitudinally in a number of locations around its perimeter (normally at 90 degree intervals). The slits, one of which is shown at 32 in FIG. 3 and one of which is shown in phantom as **32*a* in FIG. 1, form that portion of the tubular wall 12 surrounding the shot cup 22** into a group of petals which, upon encountering air resistance at their exit from the barrel, immediately spread apart causing the velocity of the wad structure to decrease markedly while releasing the shot pellets to travel forward at normal velocity.

As is apparent from the figures, the shot cup 22 and obturating cup 24 are separated from each other only by the thickness of the transverse partition 20, which is substantially no thicker than the radial thickness of the tubular wall 12 in the area immediately adjacent the partition 20. Thus the volume of both the shot cup 22 and obturating cup 24 are maximized because none of the distance separating the two cups need be allocated to space for a cushioning structure. Despite the absence of such space, a cushioning structure is nevertheless provided for limiting peak pressure in the powder chamber upon firing. The cushioning structure comprises at least one annular depression 34 formed in the exterior surface of the tubular wall 12 at a location along the length of the wad structure 10 corresponding subtantially to the location of the partition 20. The depression 34 creates an annular space 36 (FIG. 3) into which that portion of the wall 12 surrounding the obturating cup 24 can deform upwardly upon firing, as shown for example in phantom at 12*a* in FIG. 4. This upward deformation momentarily enlarges the volume of the powder chamber and provides a cushioning effect limiting peak powder chamber pressure at the instant of firing. This cushioning effect can be obtained with variously-shaped annular depressions, or with multiple longitudinally-spaced annular depressions at this location.

Figure 4:
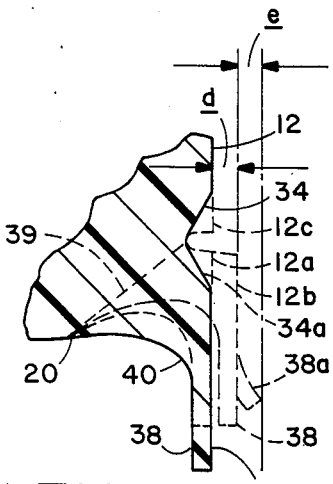
FIG. 4 is an enlarged, cross-sectional view of a portion of the obturating cup wall of the wad structure of FIG. 1.

With reference to FIG. 4, an additional function is obtainable by the upward deformation of the obturating cup wall if the interior dimension of the shell case or gun barrel is larger than the original outside diameter of the tubular wall 12, such that a tight fit between the two does not originally exist. In such case a high degree of conformable sealing is required to minimize the leakage of exploding gases from around the obturating cup wall past the wad and out the front of the barrel, which would otherwise reduce shot velocity. If, for example, the interior surface of the shell case 30 is originally at a clearance d with respect to the outer surface of the tubular wall 12, the upper portion of the wall surrounding the obturating cup will deform upon firing not only upwardly but also outwardly to seal this clearance, as indicated in phantom at 12*b* in FIG. 4. If even a further exaggerated clearance e exists, this is sealed by outward flexure of the thin, lower edge band 38 of the wall, as indicated in phantom at 38*a* in FIG. 4. It can be seen that, if the clearance d plus e existed originally, and the wad structure were not formed so as to move the top of the obturating cup wall outwardly as well as upwardly, the thin band of material 38 would probably be unable, by itself, to seal the clearance effectively and would thus permit propellant gases to leak past the wad.

The structure which causes the greater degree of sealing conformability of the obturating cup wall, as described above, is primarily the annular depression 34 immediately above the obturating cup and the fact that the top portion of the obturating cup wall 12 immediately below the depression extends radially inwardly to a greater extent than does the depression 34. This relationship defines a downwardly-converging, generally frusto-conical imaginary interface indicated as 39 (in phantom in FIG. 4) at which the obturating cup wall is connected to the remainder of the wad structure. This connecting configuration ensures that powder chamber pressure urges the top part of the obturating cup wall not only upwardly, but also outwardly.

As shown in the figures, the side surface 34*a* of the depression 34 nearer to the obturating cup is sloped so as to diverge from the bottom of the depression 34 radially outwardly and in a direction toward the obturating cup. Also, the portion of the wall 12 surrounding the obturating cup has a curved inner surface 40 which diverges from the partition 20 in substantially the same direction as the side surface 34*a* of the annular depression 34. These surfaces form the top of the obturating cup wall into a generally downwardly-diverging frusto-conical shape extending substantially normal to the imaginary interface 39, and further enhance the wall's tendency to be urged outwardly by powder chamber pressure.

Figure 1:
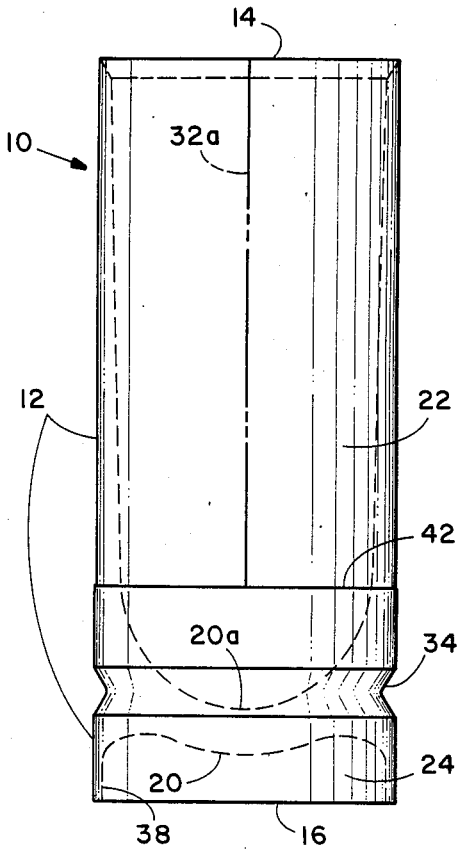
FIG. 1 is a side view of an exemplary embodiment of a wad structure constructed in accordance with the present invention.
Figure 2:
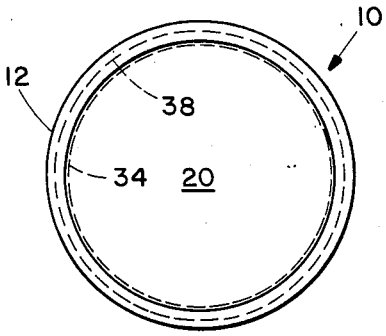
FIG. 2 is a top view of the wad structure of FIG. 1.

As shown in FIGS. 1 and 2, the partition 20 separating the shot cup from the obturating cup forms a substantially hemispherical surface 20*a* facing the shot cup 22. Due partially to the fact that the annular depression 34 has a radial depth which is substantially no greater than the radial thickness of the tubular wall 12 adjacent the partition 20 and thus does not undercut the partition, the hemispherical surface is rigid enough to remain substantially free of deformation upon firing. This ensures that the hemispherical surface 20*a* will maintain the shot pellets 26 in a pattern of surface-to-surface contact, during their passage through the barrel, which minimizes transverse diameter-to-diameter contact between the pellets. Accordingly, the pellet column can be elongated by the choke through the application of minimized constricting force, thereby avoiding excessive choke strain. An exemplary surface-to-surface contact pattern of shot pellets created by the hemispherical shot cup base is illustrated in FIG. 3. The pattern is, of course, variable with different sizes of pellets, but the hemispherical base produces the most advantageous patterns for this purpose regardless of pellet size.

In addition, reduction of choke strain is enhanced by a second cushioning function of the annular depression 34. When the end 14 of the wad encounters the choke, the wall of the shot cup is permitted to deform downwardly into the depression 34 as shown in phantom at 12*c* in FIG. 4 without causing deformation of the shot cup base. Thus the initial impact of the end 14 of the wad with the choke is cushioned by longitudinal downward movement of the shot cup wall relative to the remainder of the wad, further relieving the strain imposed on the choke.

FIG. 1 reveals that the exterior surface of the tubular wall 12 surrounding the shot cup 22 has a slightly thickened portion near the base of the shot cup and immediately above the annular depression 34, defining a slight protruding annular shoulder 42. This annular shoulder is formed at a location along the length of the wad structure corresponding substantially to the location of the peripheral juncture of the hemispherical surface 20*a* with the interior surface of the tubular wall 12. Its purpose is to serve as a guide for the user's length of cut of the slits, such as 32, which form the aforementioned petals of the shot cup wall. This is a particularly important feature for reloading applications where the user could otherwise easily cut the slits either too long or too short. If the slits are too short, the shot pellets will remain in the cup too long after discharge of the wad structure from the end of the gun barrel, thereby adversely affecting both shot velocity and shot pattern. On the other hand, if the slits 32 are too long, the wad may rupture when fired and likewise adversely affect the ballistics of the shot.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A one-piece elongate wad structure, having first and second ends, for use in a shot shell case, said wad structure having an elongate shot cup with an opening at the first end of said wad structure for containing shot pellets, and an obturating cup with an opening at the second end of said wad structure for overlying a powder chamber in said shot shell case and sealingly engaging the case, said shot cup and obturating cup being defined by an elongate tubular wall extending longitudinally between said ends of said wad structure and surrounding said cups and by a transverse partition inside said tubular wall joined integrally with said tubular wall and separating said shot cup and obturating cup, and means defining a cushioning annular depression in the exterior surface of said tubular wall adjacent said partition for limiting peak pressure in said powder chamber upon firing of the shot shell by causing a portion of said tubular wall, immediately adjacent to said depression and surrounding said obturating cup, to deform toward said shot cup into said depression upon firing of the shot shell, said partition being joined monolithically to said tubular wall throughout an annular portion of said elongate tubular wall, and said annular depression having an inner extremity substantially centrally located longitudinally with respect to said annular portion of said tubular wall, said annular depression having a radial depth which is no greater than the radial thickness of the portion of said tubular wall located immediately adjacent to said annular portion of said tubular wall and surrounding said shot cup, and having a radial depth which is no less than the radial thickness of said tubular wall at said second end of said wad structure.

2. The wad structure of claim 1 wherein said partition has a surface of concave shape facing said shot cup.

* * * * *